US009492829B2

(12) United States Patent
Mastrovito

(10) Patent No.: US 9,492,829 B2
(45) Date of Patent: Nov. 15, 2016

(54) MULTI-SPINDLE SPRAY NOZZLE ASSEMBLY

(71) Applicant: Control Components, Inc., Rancho Santa Margarita, CA (US)

(72) Inventor: Marco Mastrovito, Gioia del Colle (IT)

(73) Assignee: CONTROL COMPONENTS, INC., Rancho Santa Margarita, CA (US)

( * ) Notice: Subject to any disclaimer, the term of this patent is extended or adjusted under 35 U.S.C. 154(b) by 257 days.

(21) Appl. No.: 13/793,562

(22) Filed: Mar. 11, 2013

(65) Prior Publication Data

US 2014/0252125 A1 Sep. 11, 2014

(51) Int. Cl.

| | |
|---|---|
| ***B05B 1/14*** | (2006.01) |
| ***B05B 1/06*** | (2006.01) |
| ***B05B 1/30*** | (2006.01) |
| ***F22G 5/12*** | (2006.01) |
| ***F01K 5/02*** | (2006.01) |
| *B05B 1/02* | (2006.01) |
| *B05B 1/34* | (2006.01) |

(52) U.S. Cl.

CPC . *B05B 1/14* (2013.01); *B05B 1/06* (2013.01); *B05B 1/308* (2013.01); *B05B 1/3073* (2013.01); *F01K 5/02* (2013.01); *F22G 5/123* (2013.01); *B05B 1/02* (2013.01); *B05B 1/3405* (2013.01); *Y10S 261/13* (2013.01)

(58) Field of Classification Search

CPC ..... Y10S 261/13; F22G 5/123; F16K 47/16; B05B 1/341; B05B 1/14; B05B 1/00; B05B 1/308; B05B 1/06; B05B 1/3073; B05B 1/3405; B05B 1/02; F01K 5/02

See application file for complete search history.

(56) References Cited

U.S. PATENT DOCUMENTS

| | | | | | |
|---|---|---|---|---|---|
| 1,510,930 | A * | 10/1924 | Enell | B05B 1/06 | 239/204 |
| 2,313,994 | A * | 3/1943 | Grant | B05B 1/1609 | 239/440 |
| 2,680,652 | A * | 6/1954 | Kooistra | F23D 11/24 | 239/119 |
| 2,933,259 | A * | 4/1960 | Raskin | B05B 7/04 | 239/405 |

(Continued)

FOREIGN PATENT DOCUMENTS

| | | | | |
|---|---|---|---|---|
| DE | EP 0971168 A2 * | 1/2000 | F22G 5/123 |
| DE | 102012111801 A1 * | 6/2014 | B04B 1/12 |
| EP | 0971168 A2 | 1/2000 | |

OTHER PUBLICATIONS

International Search Report and Written Opinion for International Application No. PCT/US2014/017218; Jun. 11, 2014; 8 pages.

*Primary Examiner* — Amber R Orlando
*Assistant Examiner* — Stephen Hobson
(74) *Attorney, Agent, or Firm* — Stetina Brunda Garred and Brucker; Mark B. Garred

(57) ABSTRACT

In accordance with the present invention, there is provided a multi-spindle spray nozzle assembly for a steam desuperheating or attemperator device. The nozzle assembly features a nozzle holder which accommodates two small, spring-loaded nozzles, each of which is adapted to produce a spray pattern of reduced cone angle (e.g., approximately 60°) in comparison to currently know nozzle designs. The two nozzles are positioned within the nozzle holder such that they diverge from the axis thereof as allows the spray pattern generated thereby to be effectively tilted into the flow of steam within a desuperheating device having the nozzle assembly interfaced thereto.

20 Claims, 6 Drawing Sheets

(56) References Cited

U.S. PATENT DOCUMENTS 3,158,666 A * 11/1964 Heller ..... F28B 3/04 261/118
3,331,590 A * 7/1967 Battenfeld ..... F16K 31/363 122/459
3,741,482 A * 6/1973 Eliason ..... B29C 44/367 239/296
3,863,841 A * 2/1975 Berthoud ..... B05B 1/14 137/510
3,913,845 A * 10/1975 Tsuji ..... F02M 61/182 239/432
4,130,611 A * 12/1978 Brand ..... B05B 1/1672 122/487
4,565,324 A * 1/1986 Rebula ..... B05B 1/14 122/390
4,880,447 A * 11/1989 Bloch ..... B01F 3/022 261/116
4,893,752 A * 1/1990 Spink ..... B05B 7/08 239/427.3
5,045,245 A * 9/1991 Chawla ..... B05B 7/0458 261/44.2
5,289,976 A * 3/1994 Dou ..... B01J 8/1827 239/431
5,290,486 A * 3/1994 Enarson ..... B01F 5/045 239/471
5,423,483 A * 6/1995 Schwade ..... B08B 3/02 122/392
5,474,235 A * 12/1995 Cole ..... B05B 1/00 239/431
5,505,163 A * 4/1996 Jameel ..... B05B 1/34 122/379
5,553,783 A * 9/1996 Slavas ..... B05B 1/3405 239/403
5,692,682 A * 12/1997 Soule ..... 239/403
5,794,854 A * 8/1998 Yie ..... B05B 1/14 239/242
5,862,992 A * 1/1999 Stinson ..... B01D 19/0015 239/440
6,250,569 B1 * 6/2001 Taccon ..... B05B 1/14 239/407
6,691,929 B1 2/2004 Sherikar
6,746,001 B1 * 6/2004 Sherikar ..... F22G 5/123 122/487
7,028,994 B2 4/2006 Sherikar
7,584,604 B2 * 9/2009 Masaki ..... B01F 3/04049 239/437
7,654,509 B2 2/2010 Freitas et al.
7,850,149 B2 12/2010 Sherikar et al.
8,011,176 B2 * 9/2011 Hirata ..... B01D 53/9409 60/286
8,177,148 B1 * 5/2012 Renquist ..... B05B 1/14 239/200
8,770,155 B2 * 7/2014 Tandra ..... F23J 3/023 122/405
2006/0086831 A1 * 4/2006 Tsai ..... A62C 31/05 239/553
2008/0191056 A1 * 8/2008 deLesdernier ..... B05B 1/14 239/403
2009/0278266 A1 * 11/2009 Freitas ..... B05B 1/06 261/62
2011/0079664 A1 * 4/2011 Stednitz ..... B05B 1/02 239/428.5
2012/0017852 A1 1/2012 Geelhart et al.
2013/0186984 A1 * 7/2013 Haruch ..... B05B 1/14 239/543
2014/0008466 A1 * 1/2014 Yows ..... C10J 3/526 239/543
2014/0090858 A1 * 4/2014 Hansen ..... B05B 1/14 169/37

* cited by examiner

MULTI-SPINDLE SPRAY NOZZLE ASSEMBLY

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

1. Field of the Invention

The present invention pertains generally to steam desuperheaters or attemperators and, more particularly, to a uniquely configured multi-spindle spray nozzle assembly for a steam desuperheating or attemperator device. The nozzle assembly features a nozzle holder which accommodates two small, spring-loaded nozzles, each of which is adapted to produce a spray pattern of reduced cone angle (e.g., approximately 60°) in comparison to currently know nozzle designs. The two nozzles are positioned within the nozzle holder such that they diverge from the axis thereof as allows the spray pattern generated thereby to be effectively tilted into the flow of steam within a desuperheating device having the nozzle assembly interfaced thereto.

2. Description of the Related Art

Many industrial facilities operate with superheated steam that has a higher temperature than its saturation temperature at a given pressure. Because superheated steam can damage turbines or other downstream components, it is necessary to control the temperature of the steam. Desuperheating refers to the process of reducing the temperature of the superheated steam to a lower temperature, permitting operation of the system as intended, ensuring system protection, and correcting for unintentional deviations from a prescribed operating temperature set point. Along these lines, the precise control of final steam temperature is often critical for the safe and efficient operation of steam generation cycles.

A steam desuperheater or attemperator can lower the temperature of superheated steam by spraying cooling water into a flow of superheated steam that is passing through a steam pipe. By way of example, attemperators are often utilized in heat recovery steam generators between the primary and secondary superheaters on the high pressure and the reheat lines. In some designs, attemperators are also added after the final stage of superheating. Once the cooling water is sprayed into the flow of superheated steam, the cooling water mixes with the superheated steam and evaporates, drawing thermal energy from the steam and lowering its temperature.

One popular, currently known attemperator design includes a plurality (typically five) nozzle assemblies which are positioned circumferentially about a steam pipe in equidistantly spaced intervals relative to each other. Each of the nozzle assemblies is adapted to produce a single, generally conical spray pattern of cooling water which is introduced into the steam flow in a direction generally perpendicularly to the axis of the steam pipe. Another popular, currently known attemperator design is a probe style attemperator which includes including one or more nozzle assemblies positioned so as to spray cooling water into the steam flow in a direction generally along the axis of the steam pipe.

One of the most commonly encountered problems in those systems integrating an attemperator is the addition of unwanted water to the steam line or pipe as a result of the improper operation of the attemperator, or the inability of the nozzle assemblies of the attemperator to remain leak tight. The failure of the attemperator to control the water flow injected into the steam pipe often results in damaged hardware and piping from thermal shock, and in severe cases has been known to erode piping elbows and other system components downstream of the attemperator. In many applications, the steam pipe is outfitted with an internal thermal liner which is positioned proximate the spray nozzle assembly or assemblies of the attemperator. The liner is intended to protect the high temperature steam pipe from the thermal shock that would result from any impinging water droplets striking the hot inner surface of the steam pipe itself. However, water buildup can also cause erosion, thermal stresses, and/or stress corrosion cracking in the liner of the steam pipe that may lead to its structural failure.

With regard to the functionality of any nozzle assembly of an attemperator, if the cooling water is sprayed into the superheated steam pipe as very fine water droplets or mist, then the mixing of the cooling water with the superheated steam is more uniform through the steam flow. On the other hand, if the cooling water is sprayed into the superheated steam pipe in a streaming pattern, then the evaporation of the cooling water is greatly diminished. In addition, a streaming spray of cooling water will typically pass through the superheated steam flow and impact the interior wall or liner of the steam pipe, resulting in water buildup which is undesirable for the reasons set forth above. However, if the surface area of the cooling water spray that is exposed to the superheated steam is large, which is an intended consequence of very fine droplet size, the effectiveness of the evaporation is greatly increased. Further, the mixing of the cooling water with the superheated steam can be enhanced by spraying the cooling water into the steam pipe in a uniform geometrical flow pattern such that the effects of the cooling water are uniformly distributed throughout the steam flow. Conversely, a non-uniform spray pattern of cooling water will result in an uneven and poorly controlled temperature reduction throughout the flow of the superheated steam. Along these lines, the inability of the cooling water spray to efficiently evaporate in the superheated steam flow may also result in an accumulation of cooling water within the steam pipe. The accumulation of this cooling water will eventually evaporate in a non-uniform heat exchange between the water and the superheated steam, resulting in a poorly controlled temperature reduction.

In addition, the service requirements in many applications are extremely demanding on the attemperator itself, and often result in its failure. More particularly, in many applications, various structural features of the attemperator, including the nozzle assembly thereof, will remain at elevated steam temperatures for extended periods without spray water flowing through it, and thus will be subjected to thermal shock when quenched by the relatively cool spray water. Along these lines, typical failures include spring breakage in the nozzle assembly, and the sticking of the valve stem thereof. Thermal cycling, as well as the high velocity head of the steam passing the attemperator, can also potentially lead to the loosening of any nozzle assembly thereof which may result in an undesirable change in the orientation of its spray angle.

Of the currently known attemperator designs highlighted above, the former wherein the spray nozzle assemblies are mounted circumferentially around the steam pipe is generally viewed as providing numerous benefits over probe style attemperators. These benefits include reduced risk of nozzle exposure to thermal shock, efficient secondary atomization attributable to the injected water having a high velocity relative to the steam flow, an even distribution of spray water over the cross-section of steam flow, and increased turbulence which enhances droplet evaporation. In this regard, keeping the spray nozzle assemblies outside the steam path reduces thermal shock, minimizes steam head loss across the attemperator, and further reduces the risk of probe breakage as a result of the high bending moment and/or vibration. In this regard, in probe style attemperators wherein the spray assembly or assemblies reside in the steam flow, thermal cycling often results in fatigue and thermal cracks in critical components such as the nozzle holder and the nozzle itself.

Various desuperheater devices have been developed in the prior art in an attempt to address the aforementioned needs. Such prior art devices include those which are disclosed in Applicant's U.S. Pat. No. 6,746,001 (entitled Desuperheater Nozzle), U.S. Pat. No. 7,028,994 (entitled Pressure Blast Pre-Filming Spray Nozzle), U.S. Pat. No. 7,654,509 (entitled Desuperheater Nozzle), U.S. Pat. No. 7,850,149 (entitled Pressure Blast Pre-Filming Spray Nozzle), and U.S. patent application Ser. No. 13/644,049 filed Oct. 3, 2012 (entitled Improved Nozzle Design for High Temperature Attemperators), the disclosures of which are incorporated herein by reference. The present invention represents an improvement over these and other prior art solutions, and provides a multi-spindle spray nozzle assembly for a steam desuperheating or attemperator device that is of simple construction with relatively few components, requires a minimal amount of maintenance, and is specifically adapted to, among other things, prevent "sticking" of the spindles thereof while allowing a substantially uniformly distributed spray pattern of cooling water generated thereby to be effectively tilted into the flow of superheated steam within a desuperheating device in order to reduce the temperature of the steam. Various novel features of the present invention will be discussed in more detail below.

SUMMARY OF THE INVENTION

In accordance with the present invention, there is provided an improved spray nozzle assembly for an attemperator which is operative to spray cooling water into a flow of superheated steam in a generally uniformly distributed spray pattern. The nozzle assembly comprises a nozzle holder which accommodates two small, spring-loaded nozzles, each of which is adapted to produce a spray pattern of reduced cone angle (e.g., approximately 60°) in comparison to currently know nozzle designs. The two nozzles are positioned within the nozzle holder such that they diverge from the axis thereof as allows the spray pattern generated thereby to be effectively tilted into the flow of steam within a desuperheating or attemperator device having the nozzle assembly integrated therein.

Each nozzle of the nozzle assembly comprises a nozzle housing and a valve element or spindle which is movably interfaced to the nozzle housing. The spindle, also commonly referred to as a valve pintle or a valve plug, extends through the nozzle housing and is axially movable between a closed position and an open (flow) position. The nozzle housing defines a generally annular flow passage. The flow passage itself comprises three identically configured, arcuate flow passage sections, each of which spans an interval of approximately 120°, though other feeding water configurations are considered to be within the spirit and scope of the present invention. One end of each of the flow passage sections extends to a gallery which is defined by the nozzle housing and extends to a first (top) end of the nozzle housing. The opposite end of each of the flow passage sections fluidly communicates with a fluid chamber which is also defined by the nozzle housing and extends to a second (bottom) end of the nozzle housing which is disposed in opposed relation to the first end thereof. A portion of the second end of the nozzle housing which circumvents the fluid chamber defines a seating surface of the nozzle assembly. The nozzle housing further defines a central bore which extends axially from the first end thereof, and is circumvented by the annular flow passage collectively defined by the separate flow passage sections, i.e., the central bore is concentrically positioned within the flow passage sections. That end of the central bore opposite the end extending to the first end of the nozzle housing terminates at the fluid chamber.

The spindle comprises a nozzle cone, and an elongate stem which is integrally connected to the nozzle cone and extends axially therefrom. An exemplary nozzle cone has an arcuate, convex outer surface, and defines a serrated or scalloped distal rim. However, other configurations may be suitable for use depending on a specific application, such as a nozzle cone having a rounded distal rim, a sharp distal rim, or a straight rather than arcuate outer surface. The stem is advanced through the central bore of the nozzle housing. A biasing spring circumvents a portion of the valve stem, and normally biases the valve element to its closed position. The biasing spring extends within the gallery, with one thereof being abutted against the nozzle housing, and the opposite end thereof being abutted against a retention collar cooperatively engaged to a distal portion of the stem.

In the nozzle assembly, the nozzle holder is fluidly connected to a cooling water source, with the opening of a valve of the attemperator facilitating the flow of cooling water into the hollow interior of the nozzle holder. The cooling water is initially, simultaneously introduced into the gallery of each nozzle of the nozzle assembly. From the gallery, the cooling water flows into each of the flow passage sections at the first end of the corresponding nozzle housing, and thereafter flows therethrough into the fluid chamber thereof. When the corresponding spindle is in its closed position, a portion of the outer surface of the nozzle cone thereof is seated against the seating surface defined by the corresponding nozzle housing, thereby blocking the flow of fluid out of the fluid chamber and hence the nozzle. An increase of the pressure of the fluid beyond a prescribed threshold effectively overcomes the biasing force exerted by the biasing spring, thus facilitating the actuation of the spindle from its closed position to its open position. When the spindle is in its open position, the nozzle cone thereof and the that portion of the corresponding nozzle housing defining the seating surface collectively define an annular outflow opening between the fluid chamber and the exterior of the nozzle assembly. The shape of the outflow opening, coupled with the shape of the nozzle cone of the spindle, effectively imparts a conical spray pattern of small droplet size to the fluid flowing from each nozzle of the nozzle assembly. The nozzle housing of each nozzle may be formed such that the central bore thereof defines one or more guide surfaces which are sized and configured to facilitate the smooth and precise movement of the spindle between in closed and open positions.

For any desuperheater or attemperator fabricated to include the multi-spindle nozzle assembly of the present invention integrated therein, it is contemplated that such desuperheater or attemperator will include three (3) such multi-spindle nozzle assemblies which are circumferentially spaced about the steam pipe at intervals of approximately 120°. In this regard, with each nozzle of each nozzle assembly providing about a 60° spray cone resulting in a composite spray cone of 120° generated by each nozzle assembly, the entire cross section of the steam pipe may be covered with a reduced number of nozzle assemblies in comparison to known, non-probe style desuperheater or attemperator designs. More particularly, the composite 120° spray cone generated by each nozzle assembly allows for a reduction in the number of nozzles used to cover the cross sectional area of the steam pipe, making it possible to use three dual spindle nozzle assemblies of the present invention instead of the five standard nozzles, thus saving on the cost of machining, assembling, welding, post-weld heat treatments, and non-disruptive testing. The use of two small nozzles instead of one large nozzle within each nozzle holder also provides savings in material cost, and further allows for the use of more efficient springs within each nozzle assembly, with the maximum stress being reduced to up to about 45%.

Moreover, forming the nozzle holder and attaching the nozzles thereto such that the spray cone of the reduced nozzle cone angle of approximately 60° generated by each nozzle is tilted into the flow of steam improves secondary atomization performances and increases the effectiveness of secondary breakup. The tilting also provides an advantage in homogeneity of plume concentration within the steam pipe. Thus, the nozzle assembly of the present invention introduces a non-symmetric spray plume for peripheral injection into the steam pipe.

The present invention is best understood by reference to the following detailed description when read in conjunction with the accompanying drawings.

BRIEF DESCRIPTION OF THE DRAWINGS

These, as well as other features of the present invention, will become more apparent upon reference to the drawings wherein.

Common reference numerals are used throughout the drawings and detailed description to indicate like elements.

DETAILED DESCRIPTION OF THE INVENTION

Figure 1:
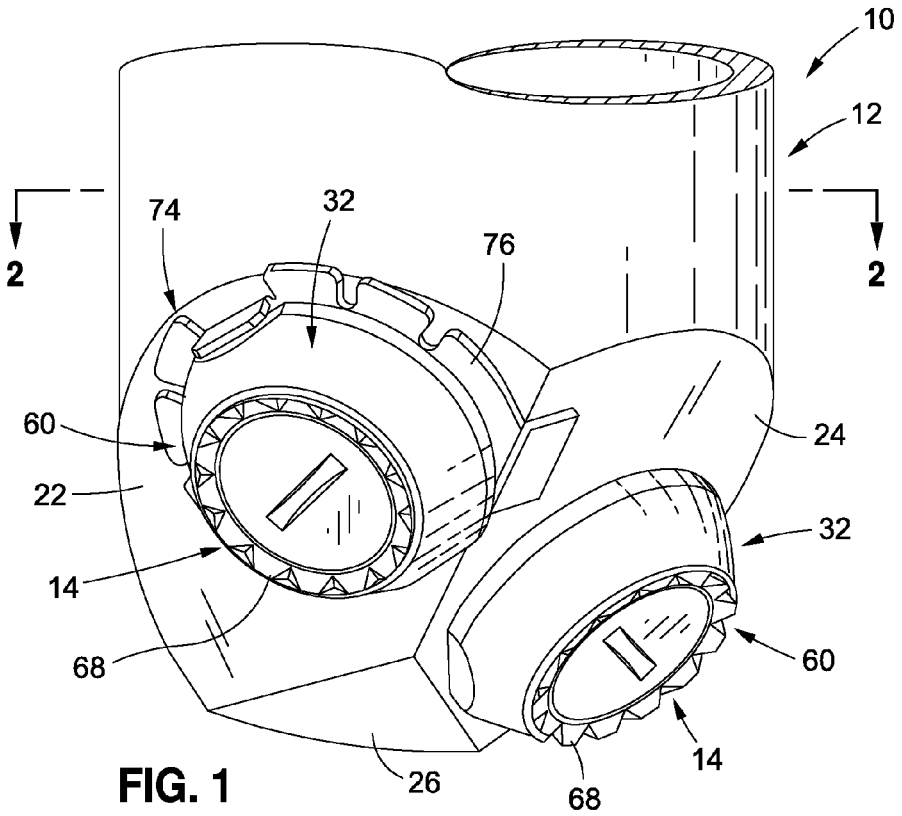
FIG. 1 is a partial, bottom perspective view of a nozzle assembly constructed in accordance with the present invention, depicting the spindles thereof in a closed position.
Figure 2:
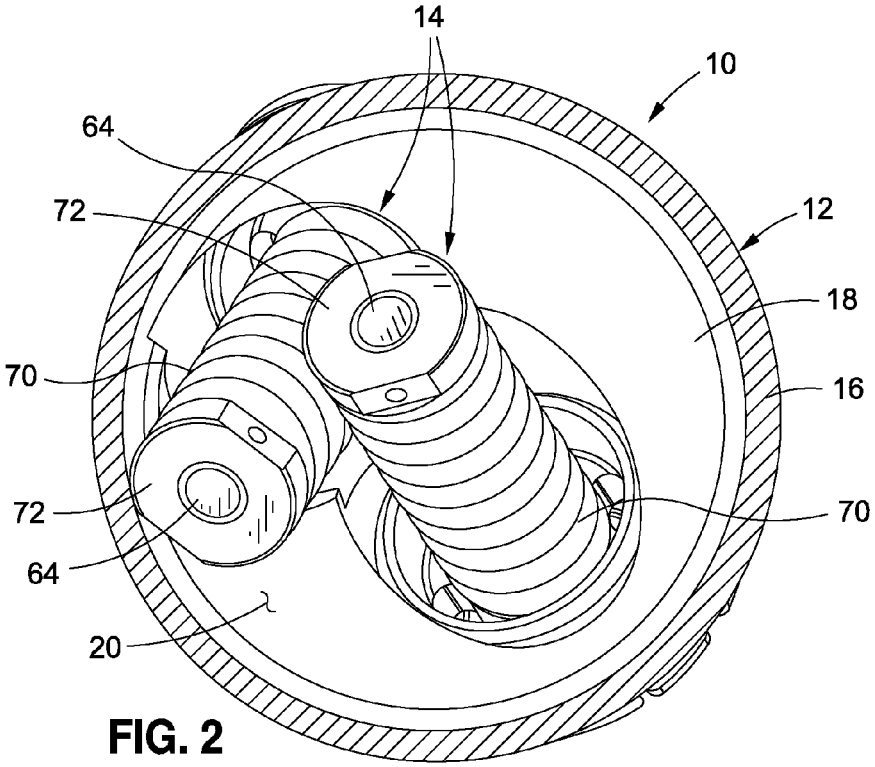
FIG. 2 is a top perspective view of the nozzle assembly shown in FIG. 1.

Referring now to the drawings wherein the showings are for purposes of illustrating a preferred embodiment of the present invention only, and not for purposes of limiting the same, FIGS. 1 and 2 depict a multi-spindle spray nozzle assembly 10 constructed in accordance with a present invention. The nozzle assembly 10 comprises a nozzle holder 12 having an identically configured pair of spray nozzles 14 cooperatively engaged thereto. In FIG. 1, each of the nozzles 14 of the nozzle assembly 10 is depicted as being in its closed position, as will be described in more detail below. The nozzle assembly 10 is adapted for integration into a desuperheating device. As will be recognized by those of ordinary skill in the art, the nozzle assembly 10 of present invention may be integrated into any one of a wide variety of different desuperheating devices or attemperators without departing from the spirit and scope of the present invention.

Figure 3:
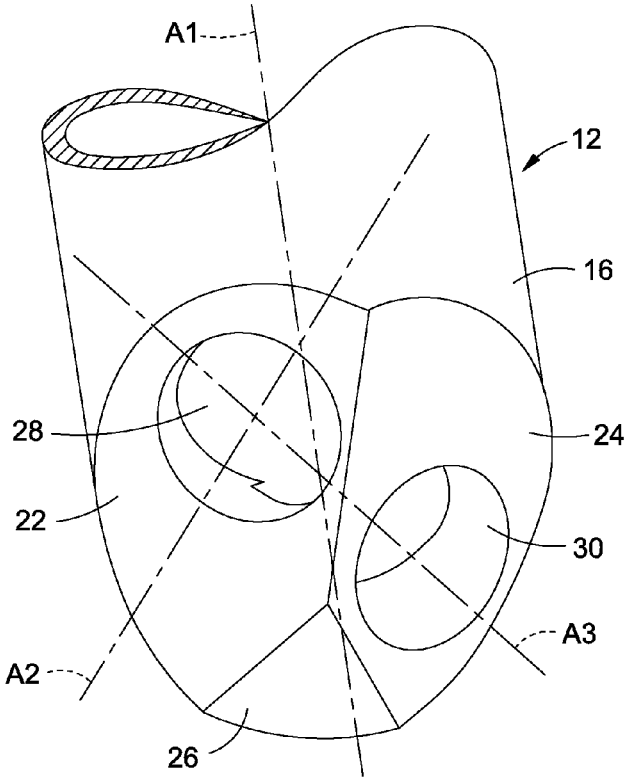
FIG. 3 is a partial, bottom perspective view of the nozzle holder of the nozzle assembly shown in FIG. 1, the nozzle holder being depicted without nozzles of the nozzle assembly being attached thereto.

As seen in FIGS. 1-3, the nozzle holder 12 is an elongate, tubular structure comprising a side wall 16 which has a generally circular cross-sectional configuration, and defines a first axis A1 (i.e., a holder axis). Formed on one end of the side wall 16 is an end wall 18, the side and end wall 16, 18 collectively defining an interior fluid chamber 20 of the nozzle holder 12. As seen in FIGS. 1 and 3, the end wall 18 defines three (3) discrete, generally planar exterior surface sections 22, 24, 26. The exterior surface sections 22, 24 have substantially similar shapes, with the exterior surface section 26 having a generally triangular configuration, and extending to each of the remaining two exterior surface sections 22, 24. In this regard, the exterior surface section 26 shares a common side with each of the exterior surface sections 22, 24, with the exterior surface sections 22, 24 sharing one common side with each other. Further, the exterior surface sections 22, 24 extend at a prescribed angle relative to each other, and to the exterior surface section 26.

Formed within the exterior surface section 22 is a circularly configured opening 28 which extends to the fluid chamber 20 and defines a second axis A2. Similarly, formed within the exterior surface section 24 is a circularly configured opening 30 which also extends to the fluid chamber 20 and defines a third axis A3. As is apparent from FIGS. 1-3, the second and third axes A2, A3 are neither parallel to the first axis A1 or to each other. Rather, the second and third axes A2, A3 each diverge from the first axis A1 and each other at prescribed angles which are intended to cause spray water generated by the nozzle assembly 10 to be effectively tilted into the flow of steam within a steam pipe having the nozzle assembly 10 interfaced thereto, as will be described in more detail below. The nozzle holder 14 may be fabricated by the completion of turning and milling operations on a forged bar of a suitable material.

The identically configured nozzles 14 of the nozzle assembly 10 of the present invention each comprise a nozzle housing 32 which is shown with particularity in FIGS. 5-8. The nozzle housing 32 has a generally cylindrical configuration and, when viewed from the perspective shown in FIGS. 5-6, defines a first, top end 34 and an opposed second, bottom end 36. The nozzle housing 32 further defines a generally annular flow passage 38. The flow passage 38 comprises three identically configured, arcuate flow passage sections 40*a*, 40*b*, 40*c*, each of which spans an interval of approximately 120°. One end of each of the flow passage sections 40*a*, 40*b*, 40*c* extends to and fluidly communicates with a gallery 42 which is defined by the nozzle housing 32 and extends to a first end 34 of the nozzle housing 32. The opposite end of each of the flow passage sections 40*a*, 40*b*, 40*c* fluidly communicates with a fluid chamber 44 which is also defined by the nozzle housing 32 and extends to the second end 36 thereof. A portion of the second end 36 of the nozzle housing 32 which circumvents the fluid chamber 44 defines an annular seating surface 46 of the nozzle housing 32, the use of which will be described in more detail below.

Figure 8:
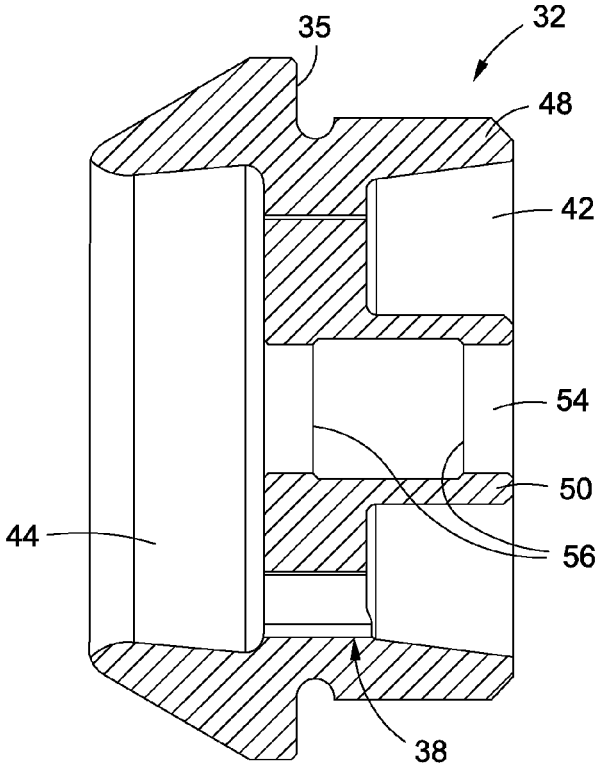
FIG. 8 is a cross-sectional view of the nozzle housing shown in FIG. 7.

As is most easily seen in FIGS. 5-8, the nozzle housing 32 defines a tubular, generally cylindrical outer wall 48, and a tubular, generally cylindrical inner wall 50 which is concentrically positioned within the outer wall 48. The inner wall 50 is integrally connected to the outer wall 48 by three (3) identically configured spokes 52 of the nozzle housing 32 which are themselves separated from each other by equidistantly spaced intervals of approximately 120°. As best seen in FIG. 8, one end of each of the spokes 52 terminates at the gallery 42 of the nozzle housing 32, with the opposite end of each spoke 52 terminating at the fluid chamber 44. The inner wall 50 of the nozzle housing 32 defines a central bore 54 thereof. The central bore 54 extends axially within the nozzle housing 32, with one end of the central bore 30 being disposed at the first end 34, and the opposite end terminating at but fluidly communicating with the fluid chamber 44. Due to the orientation of the central bore 54 within the nozzle housing 32, the same is circumvented by the annular flow passage 38 collectively defined by the separate flow passage sections 40*a*, 40*b*, 40*c*, i.e., the central bore 54 is concentrically positioned within the flow passage sections 40*a*, 40*b*, 40*c*.

Figure 4:
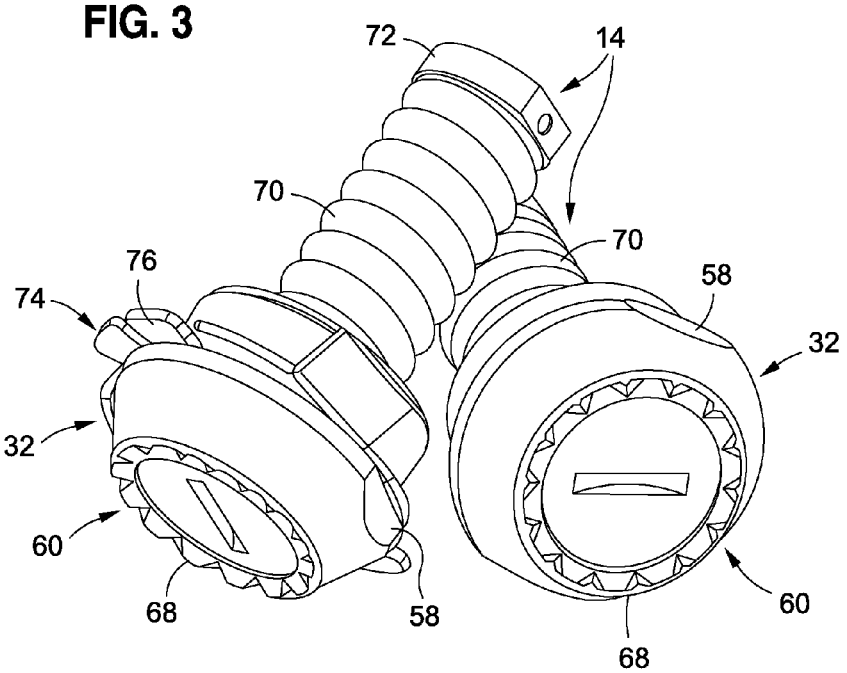
FIG. 4 is a top perspective view of the nozzles of the nozzle assembly as removed from within the nozzle holder thereof, the nozzles being depicted in their relative orientations when attached to the nozzle holder.
Figure 5:
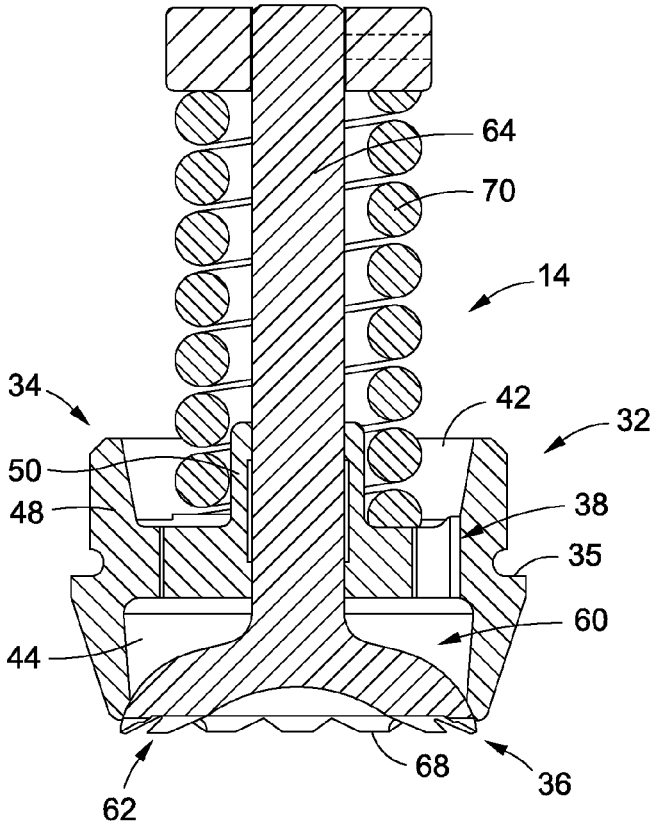
FIG. 5 is a cross-sectional view of one of the nozzles of the nozzle assembly of the present invention, depicting the spindle thereof in its closed position.

As further seen in FIG. 8, the central bore 54 is not of a uniform diameter. Rather, when viewed from the perspective shown in FIG. 8, the inner wall 50 is formed such that the central bore 54 defines an opposed pair of end sections which are each of a first diameter and are separated from each other by a middle section which is of a second diameter exceeding the first diameter. As a result, the middle section is separated from the end sections of the central bore 54 by a spaced pair of continuous, annular shoulders 56 of the inner wall 50. In the nozzle 14, the flow passage sections 40*a*, 40*b*, 40*c* are each collectively defined by the outer and inner walls 48, 50 and an adjacent pair of the spokes 52. As is most apparent from FIGS. 1, 4 and 7, a portion of the outer surface of the outer wall 48 is formed to define one or more flats 34, the use of which will be described in more detail below. The outer surface of the outer wall 48 is further formed to define a continuous, annular shoulder 35, the use of which will also be described in more detail below. In each nozzle 14 of the nozzle assembly 10, it is contemplated that the nozzle housing 32 having the structural features described above may be fabricated from a direct metal laser sintering (DMLS) process in accordance with the teachings of Applicant's U.S. Patent Publication No. 2009/0183790 entitled Direct Metal Laser Sintered Flow Control Element published Jul. 23, 2009, the disclosure of which is also incorporated herein by reference. Alternatively, the nozzle housing 32 may be fabricated through the use of a die casting process or other standard manufacturing techniques using forged bars.

Figure 9:
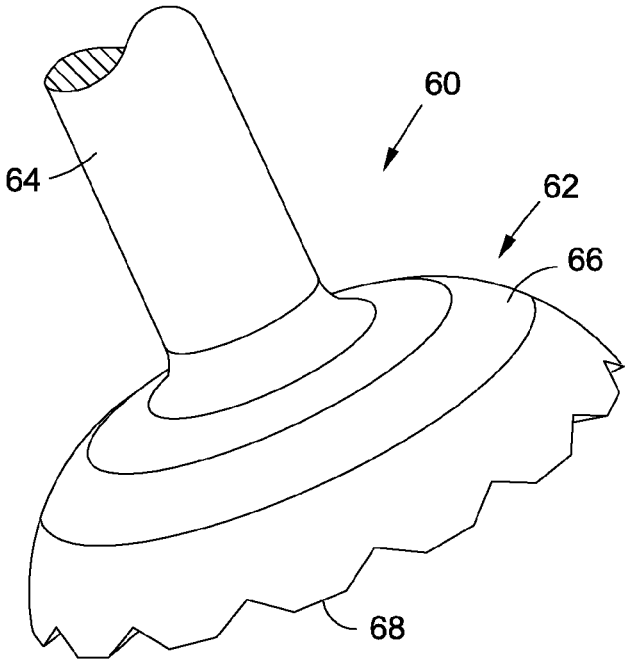
FIG. 9 is a partial, top perspective view of the spindle of one of the nozzles of the nozzle assembly of the present invention.
Figure 10:
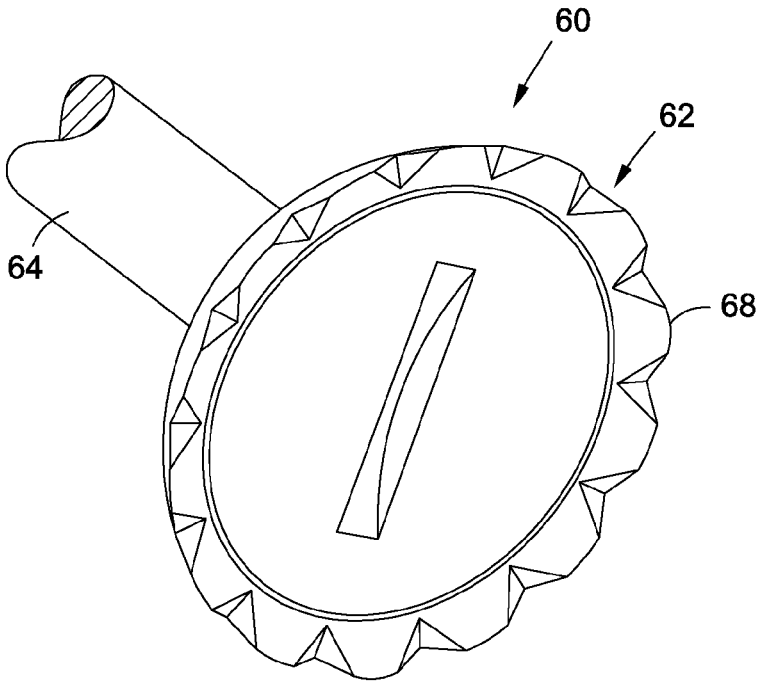
FIG. 10 is a partial, bottom perspective view of the spindle of one of the nozzles of the nozzle assembly of the present invention.

Each nozzle 14 of the nozzle assembly 10 further comprises a valve element or spindle 60 which is moveably interfaced to the nozzle housing 32, and is reciprocally moveable in an axial direction relative thereto between a closed position and an open or flow position. As best seen in FIGS. 9-10, the spindle 60 comprises a valve body or nozzle cone 62, and an elongate valve stem 64 which is integrally connected to the nozzle cone 62 and extends axially therefrom. The nozzle cone 62 has an arcuate, convex outer surface 66, and defines a serrated or scalloped distal rim 68. However, as indicated above, other configurations may be suitable for use depending on a specific application, such as a nozzle cone 62 having a rounded distal rim 68, a sharp distal rim 68, or a straight rather than arcuate outer surface 66.

In each nozzle 14 of the nozzle assembly 10, the stem 64 of the spindle 60 is advanced through the central bore 54 such that the nozzle cone 62 predominately resides within the fluid chamber 44. The nozzle 14 further comprises a helical biasing spring 70 which circumvents a portion of the stem 64. The biasing spring 70 extends within the gallery 42 of the corresponding nozzle housing 32, with one thereof being abutted against the nozzle housing 32, and the opposite end thereof being abutted against an annular retention collar 72 of the nozzle assembly 10, the retention collar 72 being cooperatively engaged to a distal portion of the stem 64. The biasing spring 70 is operative to normally bias the spindle 60 to its closed position shown in FIGS. 1 and 6. A preferred material for both the nozzle housing 32 and the biasing spring 70 is Inconel 718, though other materials may be used without departing from the spirit and scope of the present invention.

Figure 6:
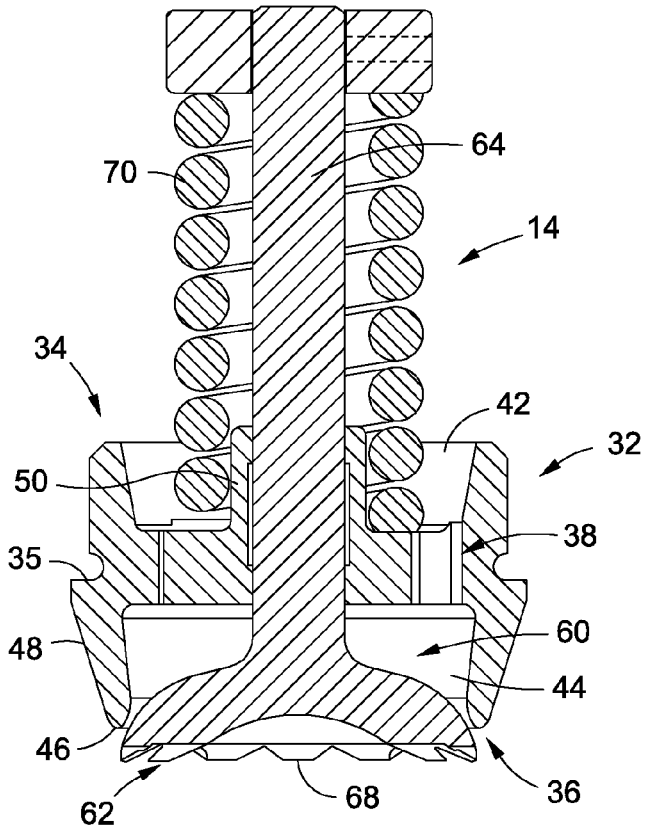
FIG. 6 is a cross-sectional view of one of the nozzles of the nozzle assembly of the present invention, depicting the spindle thereof in its open position.
Figure 7:
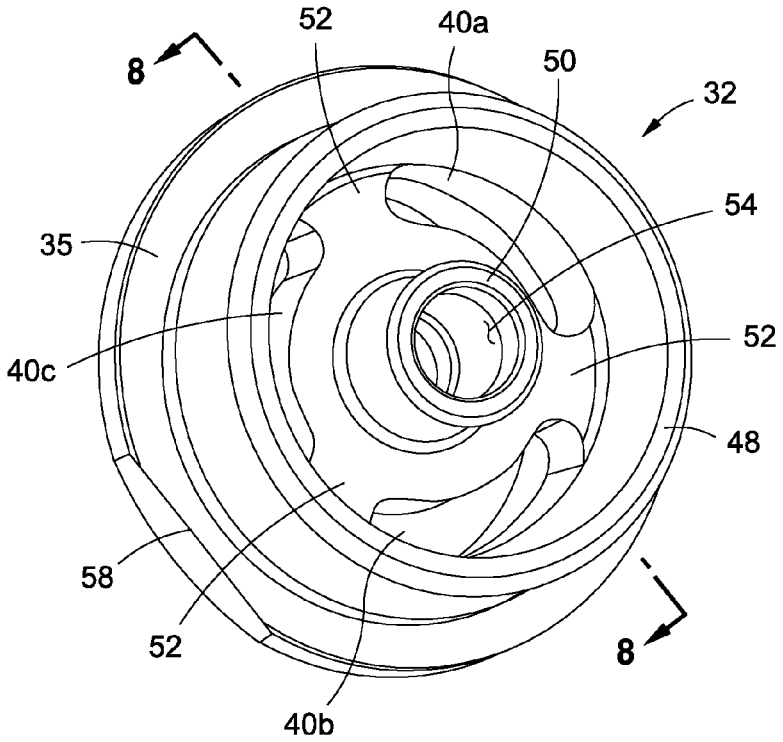
FIG. 7 is a top perspective view of the nozzle housing of one of the nozzles of the nozzle assembly of the present invention.

As indicated above, the spindle 60 of each nozzle 14 of the nozzle assembly 10 is selectively moveable between a closed position (shown in FIGS. 1 and 5) and an open or flow position (shown in FIG. 6). When the spindle 60 is in its closed position, a portion of the outer surface 66 of the nozzle cone 62 is firmly seated against the complimentary seating surface 46 defined by the nozzle housing 32, and in particular the outer wall 48 thereof. As previously explained, the biasing spring 70 extending between the nozzle housing 32 and the retention collar 72 is adapted to act against the spindle 60 in a manner which normally biases the same to its closed position.

In the nozzle assembly 10, the nozzles 14 are attached to the nozzle holder 12 by advancing portions of each of the nozzles 14 into respective ones of the openings 28, 30. More particularly, each of the nozzles 14 is advanced into a corresponding one of the openings 28, 30 until such time as the shoulder 35 defined by the nozzle housing 32 of each nozzle 14 is abutted against a corresponding one of the exterior surface sections 22, 24. When such abutment occurs, the biasing springs 70 and retention collars 72 of the nozzles 14, and hence the stems 64 of the spindles 60, each protrude into and thus reside within the fluid chamber 20 of the nozzle holder 12. In addition, the gallery 42 of the nozzle housing 32 of each nozzle 14 fluidly communicates with the fluid chamber 20. As will be recognized, when the nozzles 14 are secured to the nozzle holder 12 in the aforementioned manner, the stem 64 of the spindle 60 of that nozzle 14 advanced into the opening 28 extends along the second axis A2. Similarly, the stem 64 of the spindle 60 of that nozzle 14 advanced into the opening 30 extends along the third axis A3. As such, the first and second axes A2, A3 may further be characterized as respective nozzle axes of the nozzles 14, the axes defined by the spindles 60 of the nozzles 14 diverging from the first axis Al at prescribed angles. As will be explained in more detail below, the angular orientations of the second and third axes A2, A3 relative to the first axis A1 are intended to cause spray water generated by the nozzles 14 of the nozzle assembly 10 to be effectively tilted into the flow of steam within a steam pipe having the nozzle assembly 10 interfaced thereto.

In a desuperheater or attemperator including one or more of the nozzle assemblies 10, the opening of an on/off valve associated with the desuperheater facilitates the flow of cooling water into the fluid chamber 20 defined by the nozzle holder 12 of the nozzle assembly 10. From the fluid chamber 20, the cooling water is simultaneously introduced into the galleries 42 of the nozzle housings 32 of the nozzles 14. Advantageously, the fluid chamber 20 of the nozzle holder 12 provides a single, low-velocity feed channel for facilitating the flow of cooling water simultaneously to both nozzles 14, thus ensuring reasonable flow uniformity from the nozzles 14. Within each nozzle 14, the cooling water flows from the gallery 42 of the nozzle housing 32 into each of the flow passage sections 40*a*, 40*b*, 40*c*, and thereafter flows therethrough into the corresponding fluid chamber 44. The feeding of the cooling water to the fluid chamber 44 and hence the nozzle cone 62 of the corresponding spindle 60 through the flow passage sections 40*a*, 40*b*, 40*c* reduces pressure losses and insures more pressure drop available for atomization purposes. When the spindle 60 is in its closed position, the seating of the outer surface 66 of the nozzle cone 62 against the seating surface 46 of the corresponding nozzle housing 32 blocks the flow of fluid out of the fluid chamber 44 and hence the associated nozzle 14. An increase in the fluid pressure of the cooling water beyond a prescribed threshold effectively overcomes the biasing force exerted by the biasing spring 70 of each nozzle 14, thus facilitating the actuation of the corresponding spindle 60 from its closed position to its open position. More particularly, when viewed from the perspective shown in FIGS. 5 and 6, the compression of the biasing spring 70 of each nozzle 14 facilitates the downward axial travel of the spindle 60 thereof relative to the nozzle housing 32.

When the spindle 60 of each nozzle 14 is in its open position, the nozzle cone 62 thereof and that portion of the corresponding nozzle housing 32 defining the seating surface 46 collectively define an annular outflow opening between the fluid chamber 44 and the exterior of such nozzle 14. The shape of such outflow opening, coupled with the shape of the nozzle cone 62 of the corresponding spindle 60 and the serrated distal rim 68 defined thereby, effectively imparts a conical spray pattern of small droplet size to the fluid flowing from the nozzle 14. More particularly, the spray cone generated by each nozzle 14 of the nozzle assembly 10 when actuated to its open position is provided at a cone angle of approximately 60°, the significance of which is also discussed in more detail below. Advantageously, the serrated distal rim 68 defined by the nozzle cone 62 further provides prescribed dishomogeneities in the spray cone produced by the nozzle 14, the advantages of which will be discussed below as well. As will be recognized, a reduction in the fluid pressure flowing through the nozzles 14 of the nozzle assembly 10 below a threshold which is needed to overcome the biasing force exerted by the biasing springs 70 thereof effectively facilitates the return of the spindles 60 of the nozzles 14 from the open position shown in FIG. 6 back to the closed position shown in FIGS. 1 and 5. Along these lines, the cracking pressure of each nozzle 14 within the nozzle assembly 10 can be controlled through the selection of the biasing springs 70 included in the nozzles 14.

As indicated above, the central bore 54 of each nozzle housing 32 is not of uniform diameter, but rather includes the opposed pair of end sections which are each of a first diameter, and are separated from each other by the middle section of greater second diameter. As a result, during the movement of the spindle 60 of each nozzle 14 between its closed and open positions, the stem 64 thereof is guided by the end sections of the corresponding central bore 54, the first diameters of which only slightly exceed the outer diameter of the stem 64. This ensures smooth and precise movement of the spindle 60 due to a reduced amount of friction, which also assists in preventing the spindle 60 from sticking during movement between its closed and open positions. In addition, the cavity defined by the middle section of the central bore (attributable to its increased diameter relative to the end sections) and circumventing the stem 64 provides an area for debris collection which enables higher water flow and reduces risks of crevice corrosion.

Figure 11:
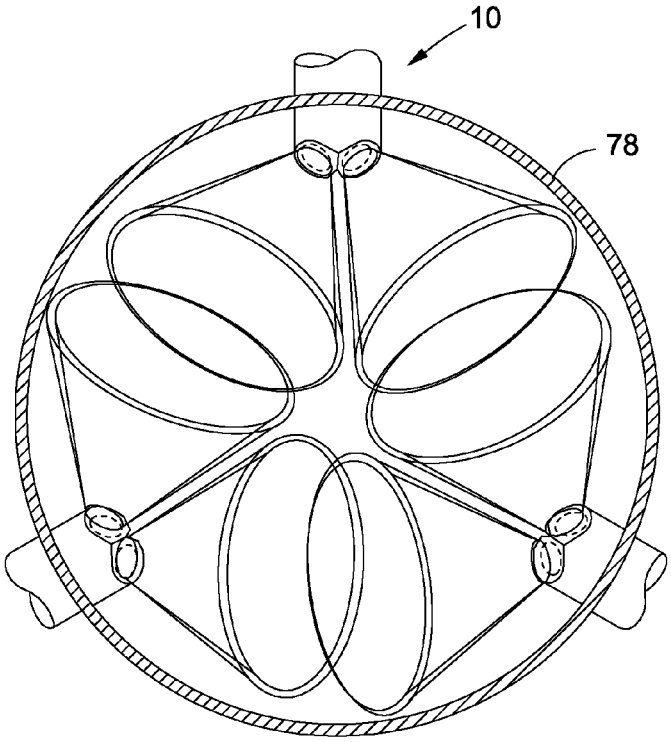
FIG. 11 is a cross-sectional view of a steam pipe depicting an exemplary manner of cooperatively engaging an attemperator thereto which comprises three nozzle assemblies which are constructed in accordance with the present invention and are each adapted to generate a composite spray cone of 120°.

Referring now to FIG. 11, for any desuperheater or attemperator fabricated to include the nozzle assembly 10 of the present invention integrated therein, it is contemplated that such desuperheater or attemperator will include three (3) such nozzle assemblies 10 which are circumferentially spaced about a steam pipe 78 at intervals of approximately 120°. In this regard, with each nozzle 14 of each nozzle assembly 10 providing about a 60° spray cone resulting in a composite spray cone of about 120° generated by each nozzle assembly 10, the entire cross section of the steam pipe 78 may be covered with a reduced number of nozzle assemblies 10 in comparison to known, non-probe style desuperheater or attemperator designs. More particularly, the composite 120° spray cone generated by each nozzle assembly 10 allows for a reduction in the number of nozzles 14 used to cover the cross-sectional area of the steam pipe 78, making it possible to use three nozzle assemblies 10 of the present invention instead of five standard nozzles as is typically the case in existing, non-probe style desuperheaters or attemperators. In this respect, as is apparent from FIG. 11, each nozzle assembly 10 includes at least two nozzles 14 being sized and configured to produce at least two independent generally conical spray cones of cooling water when cooling water flow through the nozzles.

Figure 12:
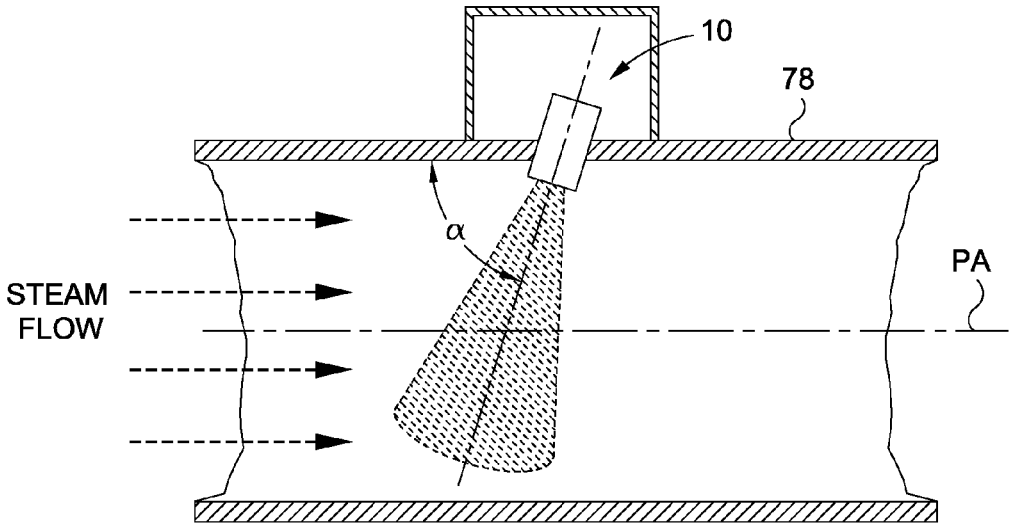
FIG. 12 is a schematic depicting the manner which the spray cone generated by an exemplary one of the nozzle assemblies shown in FIG. 11 is tilted into the path of steam flowing through a steam pipe.

Moreover, as also indicated above and as shown in FIG. 12, in each nozzle assembly 10, the nozzle holder 12 is formed and the nozzles 14 attached thereto such that the spray cone of the reduced angle of approximately 60° generated by each nozzle 14 is tilted into the flow of steam flowing through the steam pipe 78. This tilting improves the secondary atomization performance of each nozzle assembly 10 and increases the effectiveness of secondary break up. Along these lines, the dishomogeneities in the spray cone generated by each nozzle 14 attributable to the structural attributes of the nozzle cone 62 thereof (including the serrated distal rim 68) allows the steam cross flow through the steam pipe 78 to enter the windward side of the spray cone and provide good secondary atomization on the leeside of the spray cone. At the same time, the spray exhibits higher penetration in the cross flow of steam through the steam pipe 78, thus ensuring a more uniform distribution of the droplets into the steam. As is apparent from FIGS. 11 and 12, the second and third axes A2 and A3 (which coincide with the axes of respective ones of the spindles 60 of the nozzles 14), in addition to diverging from the first axis A1 of the nozzle holder 12 such that that the spray cones generated by the nozzles 14 of the nozzle assembly 10 are tilted into the flow of steam through the steam pipe 78, further diverge from the axis PA of the steam pipe 78 (i.e., neither of the first and second axes A2, A3 intersect the axis PA). Those or ordinary skill in the art will recognize that, depending on a particular application, in any nozzle assembly 10, each nozzle 14 may be configured to provide a spray cone having an angle greater or less than 60°, to produce a composite spray cone which is greater or less than 120°, without departing from the spirit and scope of the present invention.

As previously explained, in the nozzle assembly 10, the nozzles 14 are cooperatively engaged to the complimentary nozzle holder 12. As indicated above, thermal cycling, as well as the high velocity head of steam passing through an attemperator including the nozzle assembly 10, can potentially lead to the loosening of the nozzles 14 within the nozzle holder 12, resulting in an undesirable change in the orientation of the spray angle of cooling water flowing from the nozzles 14. To prevent any such rotation of each nozzle 14 relative to the nozzle holder 12, it is contemplated that each nozzle 14 may be outfitted with a tab washer 74, an exemplary one of which is shown in FIG. 1. The tab washer 74 has an annular configuration and defines a multiplicity of radially extending tabs 76 which are arranged about the periphery thereof.

When used in conjunction with a corresponding nozzle 14, the tab washer 74, in its original unbent state, is advanced over a portion of the nozzle housing 32 and rested upon the shoulder 35 defined thereby. Thereafter, the advancement of the nozzles 14 into each of the openings 28, 30 in the aforementioned manner effectively results in the compression of each tab washer 74 between the shoulder 35 of the corresponding nozzle housing 32 and a respective one of the exterior surface sections 22, 24 defined by the end wall 18 of the nozzle holder 12. Thereafter, certain ones of the tabs 76 are bent in the manner shown in FIG. 1. More particularly, at least one of the tabs 76 is bent so as to extend partially along and in substantially flush relation to a corresponding one of the flats 58 defined by the corresponding nozzle housing 32, with another one of the tabs 76 being bent so as to extend along and in substantially flush relation to an adjacent one of the exterior surface sections 22, 24. The bending of the tab washer 74 into the configuration shown in FIG. 1 effectively prevents any rotation or loosening of the associated nozzle 14 relative to the nozzle holder 12. Though not shown with particularity in FIG. 1 or 2, it is contemplated that the nozzles 14 and the nozzle holder 12 may be threadably connected to each other, with the loosening of this connection as could otherwise be facilitated by the rotation of any nozzle 14 relative to the nozzle holder 12 being prevented by the aforementioned tab washers 74.

Those of ordinary skill in the art will recognize that the second and third axes A2 and A3 (which coincide with the axes of respective ones of the spindles 60 of the nozzles 14 as indicated above) may diverge from the first axis A1 and/or each other at any one of a multiplicity of different angular increments which may be dependent upon a particular application. In this regard, the nozzle holder 12 may be fabricated in any one of several different variations as may be needed to optimize the tilt angle a (shown in FIG. 12) of the spray cone generated by each nozzle 14 relative to the inner surface of the steam pipe 78 and/or the spray direction of each spray cone relative the pipe axis PA (i.e., the orientation of the second and third axes A2, A3 relative to to the pipe axis PA) for a specific application. Along these lines, the tilt angle a and/or spray direction may be based upon one or more of the following parameters: 1) the size of the spray cones generated by the nozzles 14 of the nozzle assembly 10 (which may be functions of the fluid pressure in the corresponding nozzle holder 12 and/or the attributes of the corresponding biasing springs 70); 2) the inner diameter of the steam pipe 78; and 3) the velocity of the steam flowing through the steam pipe 78. In each instance however, when the nozzle assembly 10 is operatively engaged to a the steam pipe 78, it is contemplated that the first and second axes A2, A3 with extend in non-parallel relation to each other, to the first axis A1 and to the pipe axis PA, and will further extend in non-perpendicular relation to the first axis A1 and to the pipe axis PA. In an exemplary embodiment, the tilt angle a is about 20° for the spray cone produced by each nozzle 14 of any nozzle assembly 10 included in the attemperator used in combination with the steam pipe 78.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. A multi-spindle spray nozzle assembly for a desuperheating device configured for spraying cooling water into a steam pipe, the nozzle assembly comprising:

a nozzle holder defining an internal fluid chamber and a holder axis; and at least two nozzles attached to the nozzle holder and fluidly communicating with the fluid chamber thereof, each of the nozzles defining a nozzle axis, each nozzle including a valve stem extending within the internal fluid chamber along a respective nozzle axis, each valve stem penetrating at least one plane on which the holder axis resides such that in at least one cross sectional plane, the valve stems are non-parallel to the holder axis and overlap with each other and the holder axis;

the nozzle holder being sized and configured such the nozzle axes of the nozzles attached thereto extend at prescribed, non-parallel orientations relative to the holder axis and each other, and further do not intersect each other;

the at least two nozzles being sized and configured to produce at least two independent generally conical spray cones of cooling water when cooling water flows through the at least two nozzles.

2. The spray nozzle assembly of claim 1 wherein each of the nozzles is sized and configured to produce a generally conical spray cone of cooling water having a cone angle of about 60°.

3. The spray nozzle assembly of claim 2 wherein the nozzles are sized and configured to produce a spray pattern of cooling water having a composite cone angle of about 120°.

4. The spray nozzle assembly of claim 1 wherein each of the nozzles comprises:

a nozzle housing defining a seating surface and having a flow passage extending therethrough which fluidly communicates with the fluid chamber of the nozzle holder;

a spindle movably attached to the nozzle housing and selectively movable between closed and open positions relative thereto, a portion of the spindle being seated against the seating surface in a manner blocking fluid flow through the fluid passage and out of the nozzle when the spindle is in the closed position, with portions of the nozzle housing and the spindle collectively defining an outflow opening which facilities fluid flow through the flow passage and out the nozzle when the spindle is in the open position; and a biasing spring partially disposed within the nozzle housing and cooperatively engaged to the spindle, the biasing spring being operative to normally bias the spindle to the closed position.

5. The spray nozzle assembly of claim 4 wherein the nozzle housing defines a fluid chamber which is circumvented by the seating surface and fluidly communicates with the flow passage, and the flow passage has a generally annular configuration which circumvents at least a portion of the spindle.

6. The spray nozzle assembly of claim 5 wherein the flow passage comprises three separate flow passage segments which each fluidly communicate with the fluid chambers of the nozzle housing and the nozzle holder, and each span a circumferential interval of approximately 120°.

7. The spray nozzle assembly of claim 5 wherein the nozzle housing comprises:

an outer wall; and an inner wall which is concentrically positioned within the outer wall and defines a central bore;

the flow passage and the fluid chamber of the nozzle housing each being collectively defined by portions of the outer and inner walls, with a portion of the spindle residing within the central bore.

8. The spray nozzle assembly of claim 7 wherein the spindle comprises:

a nozzle cone which is seated against the seating surface when the spindle is in the closed position, and partially defines the outflow opening when the spindle is in the open position; and the valve stem which extends axially from the nozzle cone;

a portion of the valve stem being circumvented by the biasing spring and residing within the central bore of the nozzle housing.

9. The spray nozzle assembly of claim 8 wherein the nozzle cone of the spindle defines a generally serrated distal rim.

10. The spray nozzle assembly of claim 7 wherein:

the central bore includes a pair of end sections which are each of a first diameter and are separated by a middle section which is of a second diameter exceeding the first diameter; and the spindle is guided by the end sections during movement between the open and closed positions.

11. A multi-spindle spray nozzle assembly for a desuperheating device configured for spraying cooling water into a steam pipe, the nozzle assembly comprising:

a nozzle holder defining an internal fluid chamber and a holder axis; and at least two nozzles attached to the nozzle holder and fluidly communicating with the fluid chamber thereof, each of the nozzles defining a nozzle axis, each nozzle including a valve stem extending within the internal fluid chamber along a respective nozzle axis and including opposed first and second ends spaced apart along the respective nozzle axis, the holder axis residing on at least one plane which each valve stem penetrates such that the opposed first and second ends of each valve stem are located on opposed sides of the at least one plane;

the nozzle holder being sized and configured such the nozzle axes of the nozzles attached thereto extend at prescribed, non-parallel orientations relative to the holder axis and each other, and further do not intersect each other;

the at least two nozzles being sized and configured to produce at least two independent generally conical spray cones of cooling water when cooling water flows through the at least two nozzles.

12. The spray nozzle assembly of claim 11 wherein each of the nozzles is sized and configured to produce a generally conical spray cone of cooling water having a cone angle of about 60°.

13. The spray nozzle assembly of claim 12 wherein the nozzles are sized and configured to produce a spray pattern of cooling water having a composite cone angle of about 120°.

14. The spray nozzle assembly of claim 12 wherein each of the nozzles is sized and configured such that when the nozzle holder is attached to the steam pipe, the spray cone produced by each of the nozzles will enter the steam pipe at an angle of about 20° relative to the inner surface thereof.

15. The spray nozzle assembly of claim 11 wherein each of the nozzles comprises:

a nozzle housing having a flow passage and a central bore extending therethrough, the flow passage fluidly communicating with the nozzle holder;

a spindle extending through the central bore of the nozzle housing and selectively movable between closed and open positions relative thereto, a portion of the spindle being seated against the nozzle housing in a manner blocking fluid flow through the fluid passage and out of the nozzle when the spindle is in the closed position, with portions of the nozzle housing and the spindle collectively defining an outflow opening which facilities fluid flow through the flow passage and out the nozzle when the spindle is in the open position; and a biasing spring partially disposed within the nozzle housing and cooperatively engaged to the spindle, the biasing spring being operative to normally bias the spindle to the closed position.

16. The spray nozzle assembly of claim 15 wherein the flow passage has a generally annular configuration which circumvents at least a portion of the spindle.

17. The spray nozzle assembly of claim 16 wherein the flow passage comprises three separate flow passage segments which each span a circumferential interval of approximately 120°.

18. The spray nozzle assembly of claim 15 wherein the spindle comprises:

a nozzle cone which is seated against the nozzle housing when the spindle is in the closed position, and partially defines the outflow opening when the spindle is in the open position; and the valve stem which extends axially from the nozzle cone;

a portion of the valve stem being circumvented by the biasing spring and residing within the central bore of the nozzle housing.

19. The spray nozzle assembly of claim 18 wherein the nozzle cone of the spindle defines a generally serrated distal rim.

20. The spray nozzle assembly of claim 15 wherein:

the central bore includes a pair of end sections which are each of a first diameter and are separated by a middle section which is of a second diameter exceeding the first diameter; and the spindle is guided by the end sections during movement between the open and closed positions.

* * * * *